US007520017B2

(12) United States Patent
Wilmo et al.

(10) Patent No.: US 7,520,017 B2
(45) Date of Patent: Apr. 21, 2009

(54) STREET SWEEPER RECIRCULATION FLAP

(75) Inventors: Michael S. Wilmo, Crystal, MN (US); Gregory J. Engel, Plymouth, MN (US)

(73) Assignee: Tennant, Minneapolis, MN (US)

( * ) Notice: Subject to any disclaimer, the term of this patent is extended or adjusted under 35 U.S.C. 154(b) by 381 days.

(21) Appl. No.: 10/236,383

(22) Filed: Sep. 6, 2002

(65) Prior Publication Data

US 2004/0045582 A1 Mar. 11, 2004

(51) Int. Cl.
*E01H 1/04* (2006.01)

(52) U.S. Cl. ..... 15/83; 15/82; 15/78

(58) Field of Classification Search ..... 15/78, 15/82–84, 246, 48
See application file for complete search history.

(56) References Cited

U.S. PATENT DOCUMENTS

| | | | | | |
|---|---|---|---|---|---|
| 1,147,440 | A * | 7/1915 | Roach | 15/48 |
| 2,651,803 | A * | 9/1953 | Browne | 15/373 |
| 3,008,542 | A | 11/1961 | Steele | 55/287 |
| 3,604,051 | A | 9/1971 | Wendel et al. | 15/340 |
| 3,639,940 | A | 2/1972 | Carlson et al. | 15/352 |
| 3,649,982 | A * | 3/1972 | Mortensen | 15/84 |
| 3,756,416 | A | 9/1973 | Wood | 210/408 |
| 3,792,569 | A | 2/1974 | Carlson et al. | 55/288 |
| 3,881,215 | A | 5/1975 | Krier et al. | 15/340 |
| 3,926,596 | A | 12/1975 | Coleman | 55/304 |
| 4,017,281 | A | 4/1977 | Johnstone | 55/384 |
| 4,200,953 | A * | 5/1980 | Overton | 15/349 |
| 4,578,840 | A | 4/1986 | Pausch | 15/340 |
| 4,660,248 | A | 4/1987 | Young | 15/340 |
| 4,754,521 | A | 7/1988 | Zoni | 15/340 |
| 4,759,781 | A | 7/1988 | Olson | 55/273 |
| 5,006,136 | A | 4/1991 | Wetter | 55/290 |
| 5,276,933 | A | 1/1994 | Hennessey et al. | |
| 6,192,542 | B1 | 2/2001 | Frederick et al. | 15/84 |
| 6,195,836 | B1 | 3/2001 | Vanderlinden | 15/340.3 |
| 6,195,837 | B1 | 3/2001 | Vanderlinden | 15/348 |
| 6,421,870 | B1 * | 7/2002 | Basham et al. | 15/83 |

FOREIGN PATENT DOCUMENTS

| | | |
|---|---|---|
| DE | 1253242 | 12/1967 |
| DE | 1256241 | 12/1967 |
| EP | 0453177 | 4/1991 |
| WO | 03/069071 | 2/2003 |

* cited by examiner

*Primary Examiner*—Laura C Guidotti
(74) *Attorney, Agent, or Firm*—Altera Law Group, LLC

(57) ABSTRACT

A street sweeper system is used typically in a motorized vehicle. The sweeper utilizes a cylindrical brush rotating about an axis generally perpendicular to the vehicle's direction of motion. A conveyor belt catches debris thrown forwards and upward by the brush and moves the debris to a hopper. A recirculation flap is mounted contacting a lower rear portion of the brush. The recirculation flap deflects debris that has traveled over the top of the brush back into the brush to be recollected at the conveyor.

9 Claims, 4 Drawing Sheets

STREET SWEEPER RECIRCULATION FLAP

FIELD OF THE INVENTION

The present invention relates to motorized sweeping vehicles.

BACKGROUND OF THE INVENTION

Automated street sweeping vehicles are essential equipment for commercial and government organizations. The vehicles are used for cleaning debris from roadways, walkways, parking lots, runways, and many other ground surfaces.

For streets and highways, large sweepers are primarily used. The large sweepers are motorized (typically diesel powered) and can be custom-made or built upon a standard commercial truck chassis. The large sweepers typically include large main brushes which direct debris onto a paddled conveyor that moves the debris into a large-capacity debris hopper. The large hoppers allow the sweepers to cover greater distances without the need for emptying the hopper. The large brushes allow the sweeper to pick up larger debris (e.g. rocks, tire treads, wood pieces), thus avoiding the need for multiple passes of the sweeper or manual retrieval of the debris.

Although effective, such street sweepers often miss a certain percentage of the debris, even when the sweeper passes directly over the debris. In some cases, the debris gets caught up in the brush and passes over the top of the brush. When this happens, the debris typically falls off the back end of the brush and is ejected out the back end of the sweeper.

Such sweepers can also generate a dust cloud while in operation. Suction can be used on side brushes and on the conveyor to control this dust. Regardless, a significant amount of dust is ejected into the atmosphere at least at the periphery of the brushes during sweeping. Besides being a nuisance, the dust is a source of particulate air pollution. In some localities particulate air pollution is a major problem, and municipalities are under government mandates to reduce particulate air pollution.

What is needed is a sweeper that can pick up a high percentage of road debris by recirculating debris that passes over the top of the main brush. Further, the sweeper should reduce the amount of dust ejected into the air. The present invention fulfills these and other needs, and addresses other deficiencies of prior art implementations.

SUMMARY OF THE INVENTION

To overcome the limitations in the prior art described above, and to overcome other limitations that will become apparent upon reading and understanding the present specification, the present invention discloses a sweeper for a ground surface. The sweeper has a front end, a back end, and a forward direction of motion. The sweeper further includes a debris mover. The debris mover has an outer surface, a ground contact area defined where the outer surface of the debris mover contacts the ground surface and a horizontal axis.

The debris mover rotates about the horizontal axis so that the outer surface of the debris mover moves at least in part towards the front end of the sweeper at the ground contact area. The debris mover also includes a recirculation contact area. The outer surface of the debris mover moves at least in part downwards at the recirculation contact area as the debris mover rotates about the horizontal axis.

A recirculation flap is mounted behind the debris mover. The recirculation flap engages the recirculation contact area so that a portion of the debris traveling to the recirculation contact area is deflected back into the debris mover. The recirculation flap includes a flexible mounting flap fixably attached to the sweeper and an elongated blade connected to the mounting flap, an edge of the elongated blade engaging the debris mover.

The sweeper may include a rigid mounting angle member connected between the mounting flap and the elongated blade, and the elongated blade can be made substantially flexible. In one configuration, the flexible mounting flap is made from belted rubber sheet.

The recirculation flap may be attached proximate the back end of the sweeper. The recirculation contact area can be located between 40 degrees and 80 degrees from the ground contact area.

In one arrangement, the debris mover comprises a brush having bristles. A distal end of the recirculation flap can extend substantially within the bristles of the brush. At least a portion of the recirculation flap proximate the distal tip can oriented between 40 degrees and 60 degrees relative to vertical.

In one configuration, the sweeper includes a housing substantially surrounding a top portion and a back portion of the debris mover. A gap space is formed between the housing and the outer surface of the debris mover at the back portion, and wherein the recirculation flap substantially covers the gap space to prevent the passage of dust therethrough.

The sweeper may include a debris collector mounted forward of the debris mover. Debris is moved into the debris collector by the rotating debris mover. The debris collector may include a conveyor belt moving the debris in a generally forwards and upwards direction.

In another embodiment of the present invention a method of sweeping of debris involves moving a conveyance in a forward direction. A debris mover is rotated on a back end of the conveyance to throw the debris at least in part in a forward direction. The debris is caught on a debris collector located substantially forward of the debris mover to collect the debris. A portion of the debris is deflected towards the debris mover where an outer surface of the debris mover is moving substantially downwards to recirculate a portion of the debris passing over the debris mover back into the debris mover.

In one aspect of the method, recirculating the debris into the debris mover further involves penetrating the outer surface of the debris mover to deflect debris towards the debris mover. The method can involve moving air from a space surrounding the debris mover to remove airborne dust of the debris from the space surrounding the debris mover. In one aspect, removing airborne dust of the debris from the space surrounding the debris mover further involves blocking a portion of the space surrounding the debris mover where an outer surface of the debris mover is moving substantially downwards. Collecting the debris may also involve conveying the debris in a generally upwards and forwards direction to deposit the debris into a hopper.

In another embodiment of the present invention, a mobile sweeping system is usable for removing debris from a ground surface. The sweeping system has a forward direction of motion and a sweeping width. The sweeping system further includes a debris moving means moving debris at least in part forwards and upwards across the sweeping width. A recirculation means is mounted at a back end of the sweeping system. The recirculation means engages a back portion of the debris moving means where an outer surface of the debris moving means is moving at least in part downwards and forwards. The recirculation means deflects a portion of the debris passing over and behind the debris moving means back to the debris moving means.

The sweeping system may include a flexible mounting means resiliently coupling the recirculation means to the sweeping system. The flexible mounting means may include a belted rubber flap. The recirculation means can include a flexible deflecting means where the recirculation means contacts the debris moving means to deflect a portion of the debris passing over and behind the debris moving means back to the debris moving means.

In one configuration, the sweeping system includes housing means encompassing a rear portion of the debris moving means. The recirculation means causes an air restriction between the debris moving means and the housing means. The air restriction prevents release of a portion of airborne dust of the debris therethrough. The sweeping system may include air moving means drawing air away from a space between the debris moving means and the housing means. The air restriction between the debris moving means and the housing means traps the airborne dust for collection by the air moving means.

In one arrangement, a distal portion of the recirculation means substantially penetrates beneath the outer surface of the debris moving means. The sweeper may include debris collecting means catching a portion of the debris moved by the debris moving means across the sweeping width. The debris collecting means can include conveying means to move the debris into a hopper.

The above summary of the present invention is not intended to describe each embodiment or every implementation of the present invention. Advantages and attainments, together with a more complete understanding of the invention, will become apparent and appreciated by referring to the following detailed description and claims taken in conjunction with the accompanying drawings.

Figure 1:
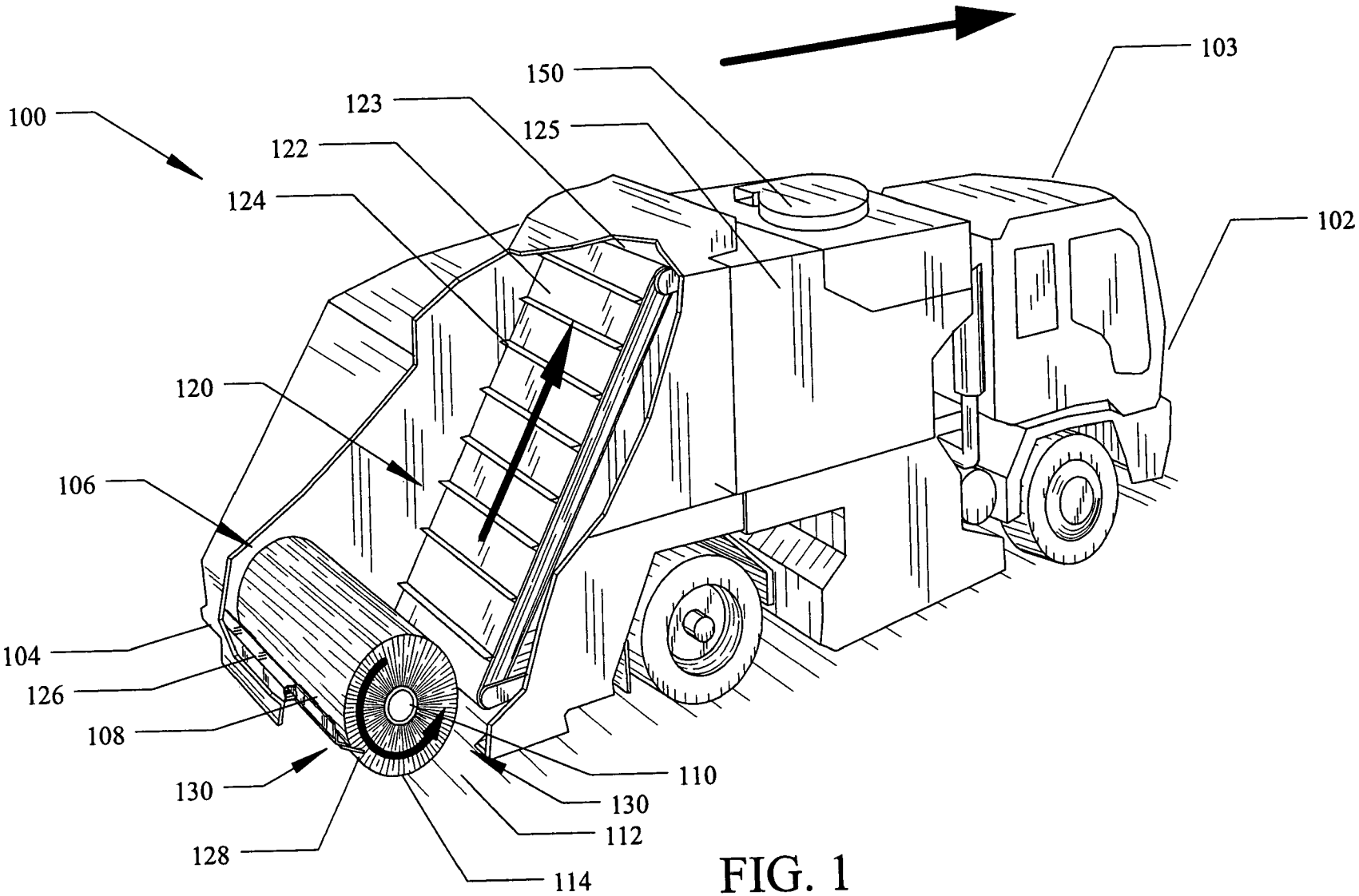
FIG. 1 is a cutaway perspective view of a street sweeper vehicle according to an embodiment of the present invention.

While the invention is amenable to various modifications and alternative forms, specifics thereof have been shown by way of example in the drawings and will be described in detail herein. For example, while the title describes a street sweeper, this refers only to a preferred embodiment since the present invention is applicable to all forms of debris gathering equipment. It is to be understood, however, that the intention is not to limit the invention to the particular embodiments described. On the contrary, the invention is intended to cover all modifications, equivalents, and alternatives falling within the scope of the invention as defined by the appended claims.

DETAILED DESCRIPTION OF THE VARIOUS EMBODIMENTS

In the following description of the illustrated embodiments, references are made to the accompanying drawings which form a part hereof, and in which is shown by way of illustration, various embodiments in which the invention may be practiced. It is to be understood that other embodiments may be utilized and structural and functional changes may be made without departing from the scope of the present invention.

Referring now to FIG. 1, a street sweeping vehicle, generally indicated by reference numeral 100, has a front end 102 and back end 104. The front end 102 of the vehicle includes a cab section 103 where an operator sits. A debris mover 106 (typically a cylindrical pickup brush) is mounted near the back end 104 of the vehicle 100. The brush 106 includes debris moving elements (e.g bristles 108) and a hub 110. The centerline of the brush 106 is oriented substantially perpendicular to the direction of forward motion of the vehicle 100, indicated by the bold, straight arrow above the vehicle 100. It is appreciated, however, that the brush 106 can be oriented non-perpendicularly (i.e. skewed).

The brush 106 is powered and rotates in the direction indicated by the bold, curved arrow. The brush 106 can rotate at varying speeds, typically in the range of 75 to 150 rpm. The brush 106 in this example has an outer diameter ranging from 36 to 18 inches (91 to 46 cm), the outer diameter typically decreasing with wear of the bristles 108.

The outer surface of the brush 106 (i.e. at the tip of the bristles 108) contacts the ground surface 112 at a contact area 114. The brush 106 throws debris from the ground surface 112 to a debris collector (in this example a conveyor) generally indicated by reference numeral 120. The conveyor 120 includes a belt 122 with paddles 124 mounted along an outer surface at regularly spaced intervals. The belt 122 rotates such that debris thrown onto the paddles 124 and is carried upwards and forwards away from the brush 106, as indicated by the angled arrow located over the belt 122. The debris leaves the top of the conveyor 120 at an exit portion 123 and drops into a hopper 125.

In the sweeping vehicle 100 according to the present invention, a recirculation flap 130 is mounted on a mounting bracket 126 behind the brush 106. The recirculation flap 130 engages the outer surface of the brush 106 at a recirculation contact area 128. The recirculation contact area 128 is located on a portion of the brush's outer surface that is moving substantially downwards and forwards as the brush 106 rotates.

Conceptually, the flap 130 is a structural element that counteracts the centrifugal trajectory of debris being expelled by the brush 106 or other debris moving device. By forcing the debris back into the brush 106, the debris will not be expelled until it reaches the appropriate collection portion of the brush's rotation (e.g. at the debris collector 120). In broad terms, the flap 130 is constructed to provide a barrier (deflector) to ejected debris and a bias element to re-introduce the debris into the brush 106.

Figure 2:
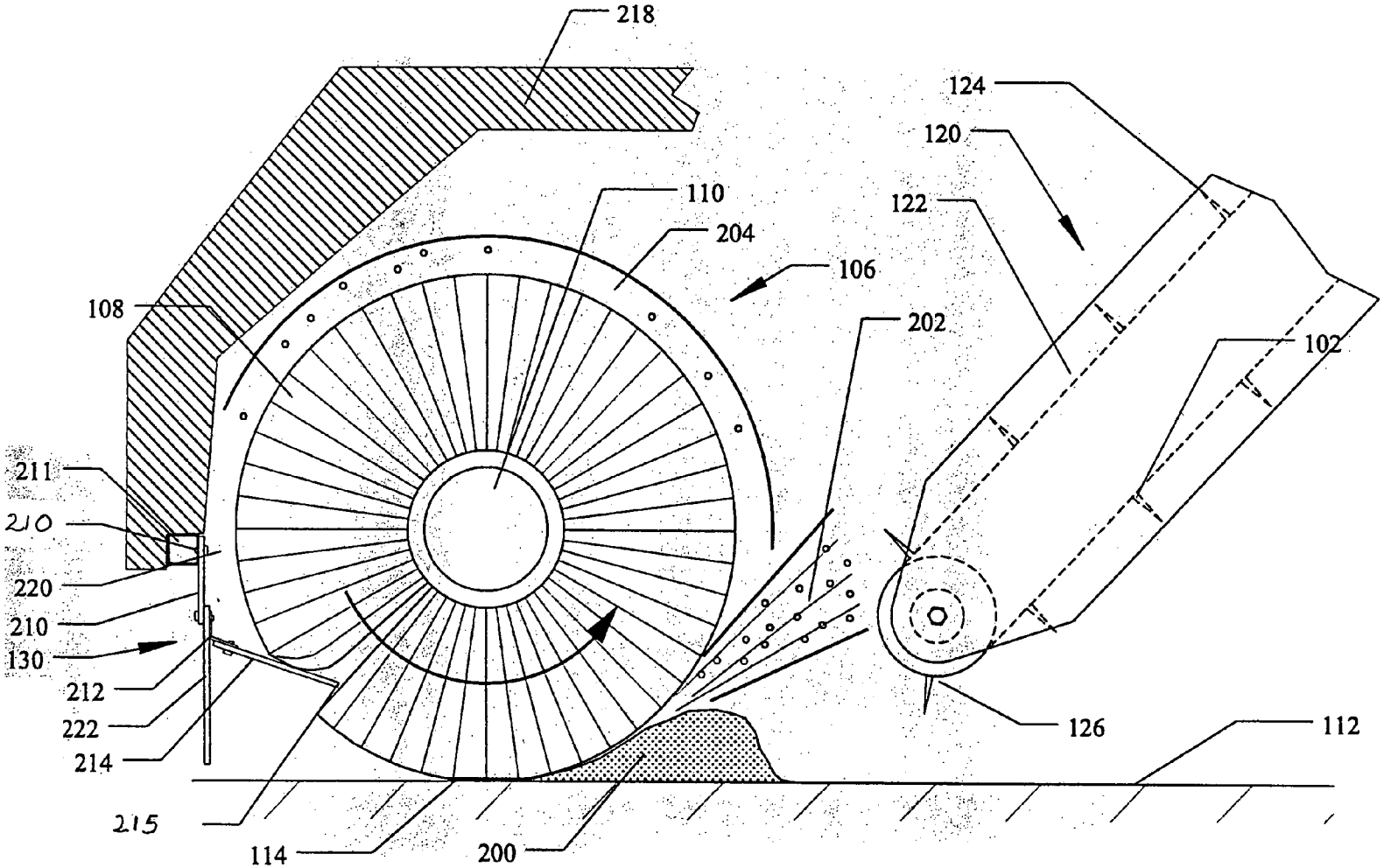
FIG. 2 is a side view of the brush, conveyor and recirculation flap according to an embodiment of the present invention.

Turning now to FIG. 2, a side view of the sweeping system illustrates the benefits of the recirculation flap 130. The brush 106 contacts the ground at the contact area 114 as it is being rotated in the direction indicated by the curved arrow. The rotation of the brush 106 at the contact area 114 tends to build up a "wedge" 200 of debris as the vehicle 100 moves forward. Most of the debris in the wedge 200 is flung upwards in a debris path 202 tangential to the brush 106 and originating where the brush 106 contacts a top portion of the wedge 200. Occasionally, debris will become trapped in the bristles 108 or otherwise be carried over the top of the brush hub 110, exemplified by debris path 204.

Debris that is carried over the top of the brush 106 in prior art sweepers will usually be ejected from behind the brush 106 and therefore missed by the sweeper. By including the recirculation flap 130, the debris is deflected back into the bristles 108 so that the debris can be carried forward (recirculated) to the wedge 200 and eventually be recovered at the conveyor 120.

The recirculation flap 130 in the illustrated embodiment includes a flexible mounting flap 210 fixably attached to a chassis bracket 211. The mounting flap 210 allows the recirculation flap 130 to conform to ground surface irregularities so as to prevent breakage of the flap 130. Note that the brush 106 and recirculation flap 130 are mounted at the rear of the vehicle 100. Due to this rear-mounted location, the up and down travel of the recirculation flap 130 due to vehicle suspension travel is far greater than sweepers having mid-mounted brushes. Therefore, although alternate structural elements may be used in place of a flexible mounting flap 210 to allow conformance of the flap 130, including spring loaded and/or slidable mounts, such alternates may be more prone to damage due to chassis movement. Unlike the alternates described, the flexible mounting flap 210 allows a flexible and resilient mount that is not easily damaged even when contacting the ground.

A rigid angle bracket 212 is coupled to the mounting flap 210 and an elongated blade 214. The angle bracket 212 can be incorporated as part of the mounting flap 210 and/or elongated blade 214, or be fabricated as a separate piece as shown. The angle bracket 212 orients the elongated blade 214 so that a portion of the blade 214 is at least touching an outer surface of the brush 106 (i.e. at the tip of the bristles 108) along the brush's width. As shown in FIG. 2, the elongated blade 214 may protrude beneath the outer surface so that a tip 215 of the elongated blade 214 extends into the bristles 108. An additional skirt 222 extends from the mounting flap 210 to close proximity with the ground. The skirt 222 could also be formed by further extending the mounting flap 210 downward.

It is appreciated that other embodiments of the recirculation flap 130 may be constructed to deflect debris back into the brush 106. In some applications, the portion of the recirculation flap 130 contacting the brush may be non-linear (e.g. curved or jagged). The recirculation flap 130 may have components that are non-planar, such as an elongated blade 214 that is formed from an elongated member with curved cross sectional shape. A blade 214 with a curved cross section may, for example, be shaped to substantially conform to the brush's outer surface.

It is also appreciated that the recirculation flap 130 helps reduce the release of airborne dust particles from the sweeper 100. A housing 218 encloses at least a portion of the brush 106. A gap 220 exists between the inner surface of the housing 218 and a rear portion of the brush 106. The recirculation flap 130 closes at least part of the gap 220 along the width of the brush 106, thereby preventing the release of dust therefrom. The dust that is contained by the recirculation flap 130 can then be removed by a vacuum system 150 (best seen in FIG. 1). Skirt 222 further contains dust and improves the effectiveness of the vacuum system.

Figure 3:
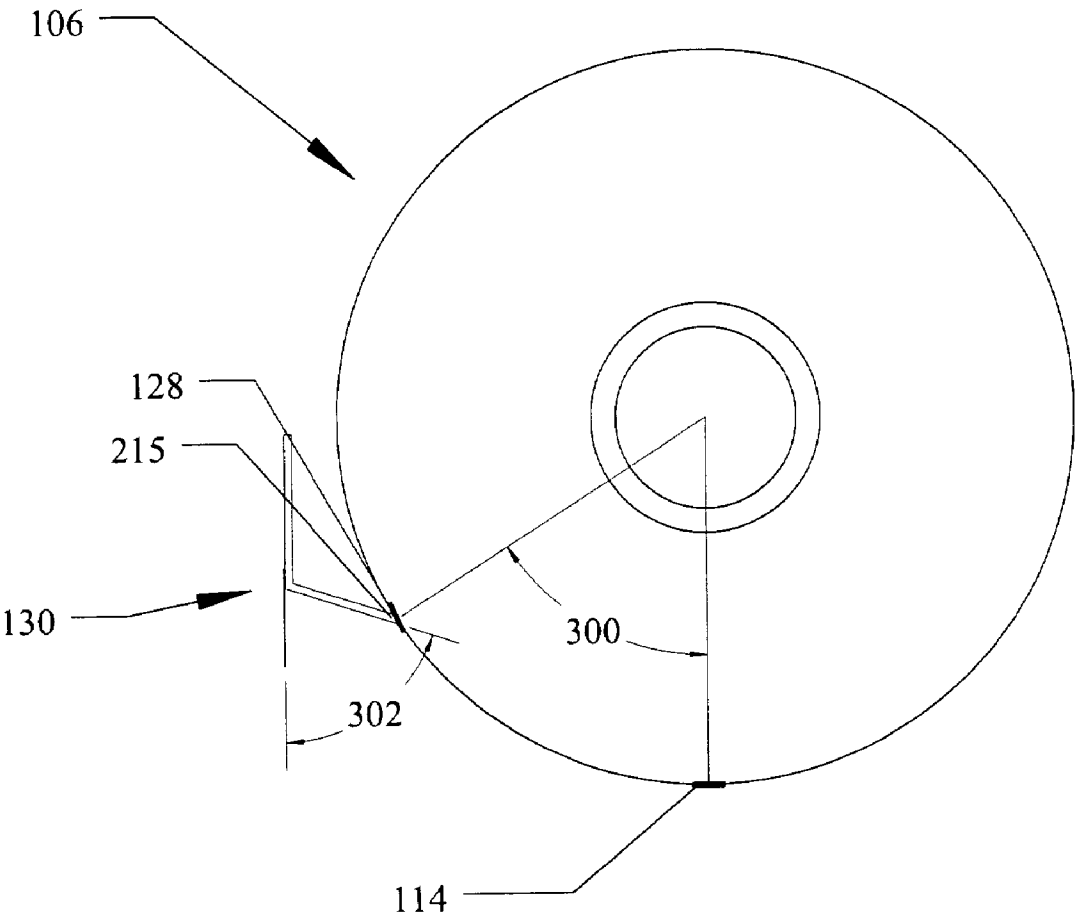
FIG. 3 is a side view of the brush and recirculation flap showing geometric details according the an embodiment of the present invention.

A particular useful arrangement of a recirculation flap 130 and brush 106 are shown in FIG. 3. The recirculation flap 130 contacts the brush 106 at a recirculation contact area 128. The recirculation contact area 128 can be located anywhere the brush's outer surface is moving at least in part downwards. Typically, the recirculation contact area 128 located at a contact angle 300 measuring between 20 degrees to 90 degrees clockwise from the ground contact area 114, preferably 63±2 degrees. For a brush 106 with a nominal outer diameter of 35.5 inches (90 cm), this corresponds to locating the tip 215 of the recirculation flap 130 between 4.1 and 14.7 inches (10 and 37 cm) above the ground, preferably 6.75±0.50 inches (17.1±1.2 cm). The elongated blade 214 is oriented at a mounting angle 302 which is from 0 degrees to 90 degrees from vertical, preferably about 50±2 degrees. It is appreciated that the nominal brush diameter of 35.5 inches (90 cm) used in this example is that of an unworn brush 106. The diameter of a worn brush 106 may decrease to 19 inches (48 cm) or less. Given a smaller (or larger) diameter brush 106, the contact angle 300 may change from this optimum range, as well as the amount of penetration (if any) of the blade tip 215 into the bristles. Regardless, the recirculation flap 130 has been found to be beneficial even with a worn brush 106.

Figure 4:
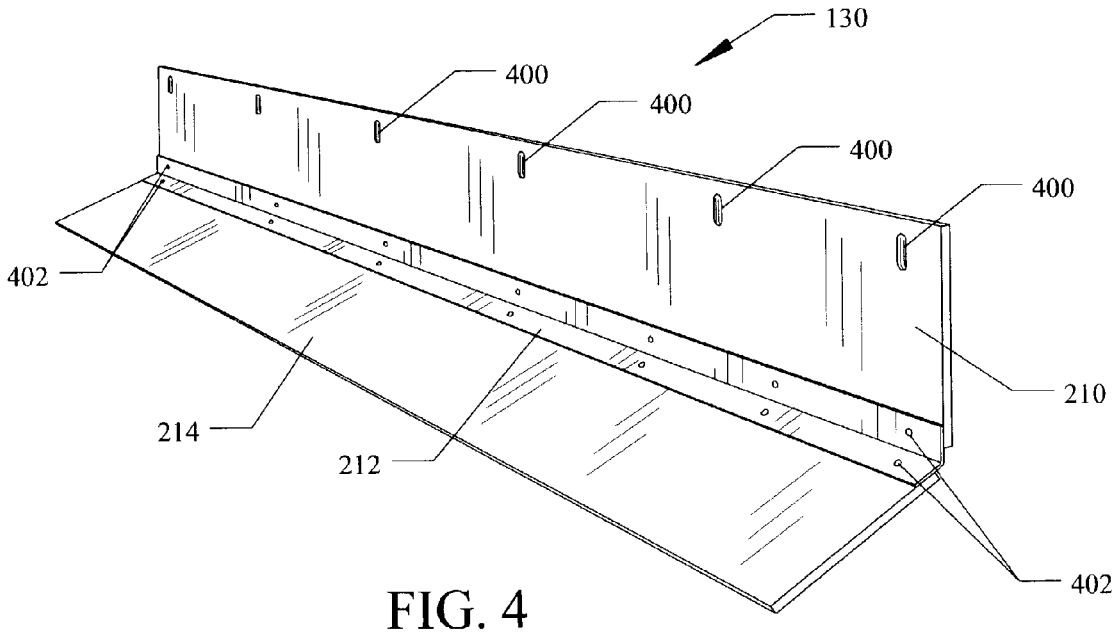
FIG. 4 is a perspective view of the recirculation flap according to an embodiment of the present invention.

Turning now to FIG. 4, a particularly useful embodiment of a recirculation flap 130 is shown. The mounting flap 210 and elongated blade 214 are typically made of two- or three-ply sheet rubber product such as ⅜ inch (0.95 cm) thick Goodyear Plylon® (220B 3/16×1/16, Class I). Making the elongated blade 214 from relatively flexible rubber helps prevent damage to the blade and/or vehicle caused by heavy objects and ground surface irregularities. Further, use of sheet rubber in fabricating the mounting flap 210 and elongated blade 214 help provide damping of the assembly and reduce noise.

The mounting flap 210 can be attached to the chassis bracket 211 using standard fasteners 215 (best seen in FIG. 2) through mounting slots 400. The angle bracket 212 can be formed from sheet metal, typically 0.08 inch to 0.12 inch thick (2.0 to 4.5 mm) carbon steel. An equivalent strength aluminum or magnesium material may be used where low weight or corrosion resistance is desired. The angle bracket 212 is fastened to the mounting flap 210 and elongated blade 214 by using fasteners 402. Any type of fastener 402 can be used, such as bolts and/or rivets.

Figure 5:
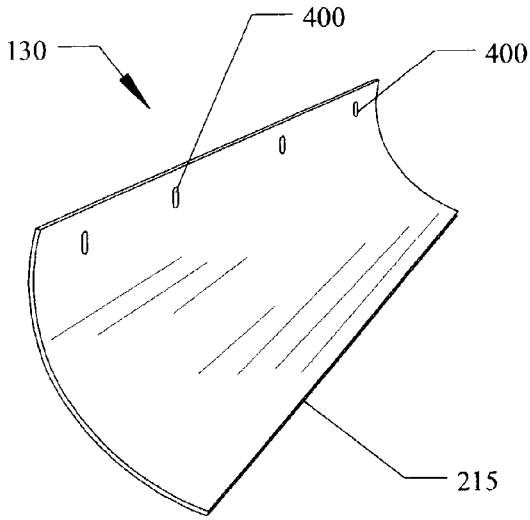
FIG. 5 is a perspective view of the recirculation flap according to another embodiment of the present invention.
Figure 6:
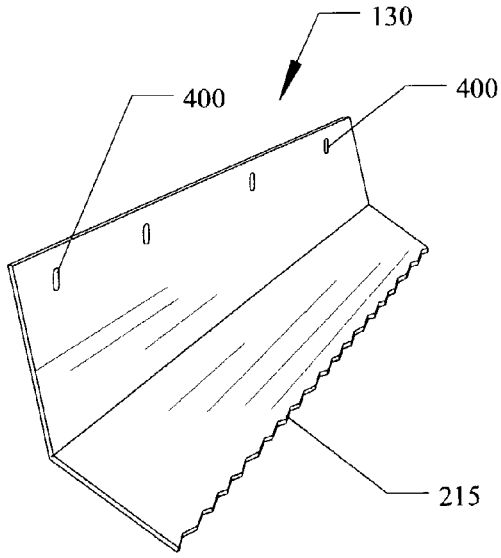
FIG. 6 is a perspective view of the recirculation flap according to yet another embodiment of the present invention.

FIGS. 5 and 6 shows alternate configurations of a recirculation flap 130. In FIG. 5, the recirculation flap 130 is formed from a single piece of material have a curved cross sectional area. In FIG. 6, the recirculation flap 130 can be of a single or multiple piece design (e.g. like that shown in FIG. 4), and further having a jagged distal edge 215.

Although the sweeping system of the present invention has been described in conjunction with a self propelled vehicle 100, it is appreciated that a brush 106, conveyor 120, and recirculation flap 130 can be used in any conveyance, such as trailers or push sweepers. The recirculation flap 130 can also be used on smaller sweeping systems that have alternate conveyor 120 embodiments or sweeping systems that do not include conveyors (e.g. debris is swept directly into a hopper).

It will, of course, be understood that various modifications and additions can be made to the preferred embodiments discussed hereinabove without departing from the scope of the present invention. Accordingly, the scope of the present invention should not be limited by the particular embodiments described above, but should be defined only by the claims set forth below and equivalents thereof.

What is claimed is:

1. A sweeper for sweeping ground surfaces of a ground contact area generally beneath the sweeper, the sweeper having a front end, a back end, and a forward direction of motion, the sweeper further having a rotating brush having an outer peripheral surface and substantially radially extending bristles, said brush rotating on a substantially horizontal axis so that the outer surface of the brush moves at least in part towards the front end of the sweeper at the ground contact area; and a recirculation contact area generally rearward of the brush, the outer surface of the brush moving at least in part downwards at the recirculation contact area as the brush rotates about the horizontal axis; and a recirculation flap mounted behind the rotating brush, the recirculation flap engaging the recirculation contact area so that a portion of the debris traveling to the recirculation contact area is deflected back into the sweeper, the recirculation flap comprising:

a) a flexible mounting section extending from the sweeper;

b) a substantially rigid mounting bracket resiliently attached to the flexible mounting section;

c) a substantially particulate impervious substantially solid curved elongated blade connected to the mounting bracket, an edge of the elongated blade being biased into at least initially into substantial penetration of the bristles by bias force exerted by said bracket and wherein elongated blade includes a curved cross sectional area including a concave surface oriented to face bristles tips.

2. The sweeper of claim 1, wherein at least a portion of the elongated blade is solid non filamentary material which penetrates substantially into the bristles.

3. The sweeper of claim 1, wherein the elongated blade is solid material includes a jagged distal edge which engages said bristles.

4. The sweeper of claim 1 wherein the recirculation flap further includes a skirt portion extending downwardly beyond said bracket toward the ground.

5. The sweeper of claim 1, wherein brush comprises a brush having bristles with bristle tips and shafts and wherein said elongated blade contacts, at least initially, the bristles tips and shafts.

6. The sweeper of claim 5, wherein a distal end of the recirculation flap extends substantially within the bristles of the brush.

7. The sweeper of claim 1, further comprising a housing substantially surrounding a top portion and a back portion of the debris mover, a gap space formed between the housing and the outer surface of the debris mover at the back portion, and wherein the recirculation flap substantially covers the gap space to prevent the passage of dust therethrough.

8. The sweeper of claim 1, further comprising a debris collector mounted forward of the debris mover so that debris is moved into the debris collector by the rotating debris mover.

9. The sweeper of claim 8, wherein the debris collector comprises a conveyor belt moving the debris in a generally forwards and upwards direction.

* * * * *